United States Patent [19]

Gray

[11] 3,956,572

[45] May 11, 1976

[54] COOLING MEANS FOR ELECTRIC ARC FURNACES

[75] Inventor: Ronald D. Gray, Bethel Park, Pa.

[73] Assignee: Pennsylvania Engineering Corporation, Pittsburgh, Pa.

[22] Filed: Mar. 11, 1975

[21] Appl. No.: 557,415

[52] U.S. Cl. ..... 13/32
[51] Int. Cl.[2] ..... F27D 1/12
[58] Field of Search ..... 13/32, 35

[56] References Cited

UNITED STATES PATENTS

| | | | |
|---|---|---|---|
| 3,743,752 | 7/1973 | Furuhashi | 13/35 X |
| 3,777,043 | 12/1973 | O'Neill | 13/32 |
| 3,829,595 | 8/1974 | Nanjyo et al. | 13/35 X |

*Primary Examiner*—R. N. Envall, Jr.
*Attorney, Agent, or Firm*—Fred Wiviott

[57] ABSTRACT

A coolant fluid chamber is affixed to the shell of an electric arc furnace to cool and decrease erosion of the refractory lining of the furnace caused by localized heating and arc flaring. The wall of the cooling chamber adjacent the furnace shell comprises a diaphragm or sheet of flexible material which is subject to deformation when the space between it and the furnace shell is evacuated and the sheet is pressed. The interface between the diaphragm and shell is coated with a flowable or deformable heat conductive material prior to attachment of the chamber to the furnace so that this material will flow into any void spaces in the interface to thereby enhance thermal conduction.

15 Claims, 4 Drawing Figures

COOLING MEANS FOR ELECTRIC ARC FURNACES

BACKGROUND OF THE INVENTION

This invention relates to electric furnaces and is more particularly concerned with cooling electric arc furnaces externally so as to minimize erosion of the refractory furnace lining resulting from localized heating and arc flaring.

In one type of electric arc furnace the electrodes are held in spaced relationship with the molten bath in the furnace and an electric arc is drawn between the electrodes and the bath to provide heat for processing the metal.

Electric arc furnaces are variously designed for using one or more electrodes and the electrodes may be supplied with alternating or direct current. Some arc furnaces use consumable electrodes of graphite or carbon and others use non-consumable electrodes which may be constructed of refractory materials and partially of metallic components on which the arc is struck.

When an electric arc furnace is operating, the refractory lining of the furnace is subjected to heat which is radiated from the melt and the arc and there is often localized heating resulting from the arc flaring and directly contacting the refractory. Localized overheating in certain zones results in rapid deterioration and erosion of the refractory in these zones. This is a well known occurrence in electric arc furnaces and it has received much attention because localized erosion compels rebuilding of the furnace lining prematurely.

Attempts to minimize the adverse effects of arc flaring and localized overheating have involved controlling the bath temperature, optimizing the distance between the bath and electrodes to obtain a more stable arc and by controlling the applied voltage. Another proposed solution to the problem has been to use non-consumable electrodes that are provided with electromagnets which produce a magnetic field that causes the arc generated by the electrode to rotate and thereby reduce the time during which it dwells on any surface area of the refractory.

On some occasions, the outer shell of the electric arc furnace is provided with a coolant chamber for taking the heat away from the shell and adjacent refractory lining as rapidly as possible. However, prior art furnace cooling means have not been fully effective to minimize thermal deterioration and erosion since there is usually metal-to-metal contact between the cooling jacket and the furnace shell such that any irregularity between the interfacing surfaces produces interstices which are occupied by air which has poor thermal conductivity.

SUMMARY OF THE INVENTION

A primary object of the present invention is to provide a cooling means for the refractory lining of electric furnaces.

Another object is to provide a cooling means for electric furnaces which maximizes heat transfer from the refractory lining of the furnace to an externally applied coolant.

A further object is to provide a cooling means which is applicable to various kinds of electric furnaces and other metallurgical vessels as well.

How the foregoing and other more specific objects of the invention are achieved will appear in the course of the more detailed description of a preferred embodiment of the invention which will be set forth hereinafter in reference to the drawings.

The invention is characterized by the use of one or more cooling chambers in contact with the outer surface of the metal shell of the furnace or vessel. The chamber has an inlet and outlet for coolant fluid. The side of the chamber which is in contact relation with the shell of the furnace for conducting heat away from the refractory material on the other side of the shell preferably comprises a diaphragm or a flexible sheet of material which has good heat conductive properties. The chamber is fastened to the metal shell in such manner that the space between the flexible sheet and the shell is leak proof. Before the chamber is attached, the sheet is preferably coated with a flowable or deformable heat conductive material. Means are provided for evacuating the interspace between the sheet and the shell such that atmospheric pressure compels the sheet and the interfacing layer of flowable material to deform. Thus, irregularities or voids at the interface are filled with the material and heat transfer is thereby enhanced because of the lack of discontinuities at the interface. In some cases a single cooling chamber may be applied to each side of the furnace for more generalized cooling and in other cases where only particular zones need to be cooled, such as where arc flaring occurs, a plurality of cooling chambers may be distributed on the external surface of the furnace. Use of several chambers has the advantage of avoiding furnace shutdown in the event one of the chambers fails due to physical damage or the development of a leak.

DESCRIPTION OF THE PREFERRED EMBODIMENT

Figure 1:
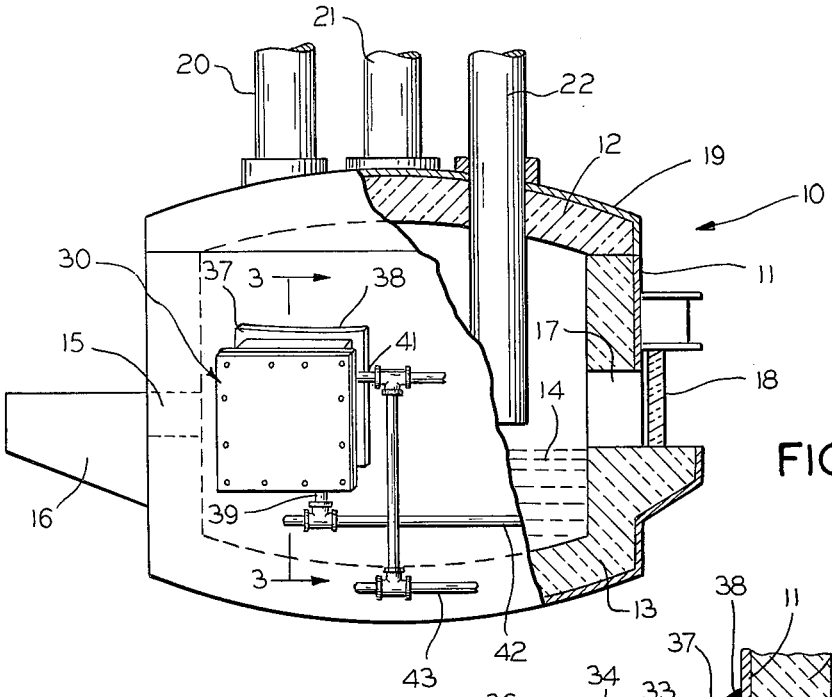
FIG. 1 is a side elevation view, with parts broken away of the electric furnace showing the new coolant chambers applied to the exterior thereof.

FIG. 1 illustrates an electric arc furnace to which the new cooling means may be applied. The furnace 10 includes an outer metallic shell 11 having a refractory lining 12. In the case of a basic furnace, refractory lining 12 may be composed of any suitable basic material such as magnesite or high alumina brick. In the case of an acid furnace the lining may be silica brick or ground ganister mix. The refractory bottom lining 13 of the vessel is dish shaped and serves as a hearth. The hearth supports a molten mass 14. One side of the furnace has an opening 15 through refractory lining 12 and metal shell 11 which opening communicates with a pouring spout that is generally designated by the numeral 16. Another side of the furnace has an opening 17 in front of which there is a door 18 that is movable upwardly from the position in which it is shown in FIG. 1 to permit introducing materials into the furnace through opening 17 and to permit raking slag from the furnace interior if desired.

The furnace also has a cover which is shown schematically and is designated generally by the reference numeral 19. Three arcing electrodes 20, 21 and 22 are shown extending through suitable openings suchc as in the cover 19. The means for energizing the electrodes are not shown nor are the means for supporting the electrodes so that they can be advanced and retracted with respect to the molten bath 14 to thereby establish an electric arc between the electrode and the bath. The furnace illustrated in FIGS. 1 and 2 has three electrodes but it will be understood that the new cooling means may be used with arc furnaces may have one, two or more than three electrodes.

Figure 2:
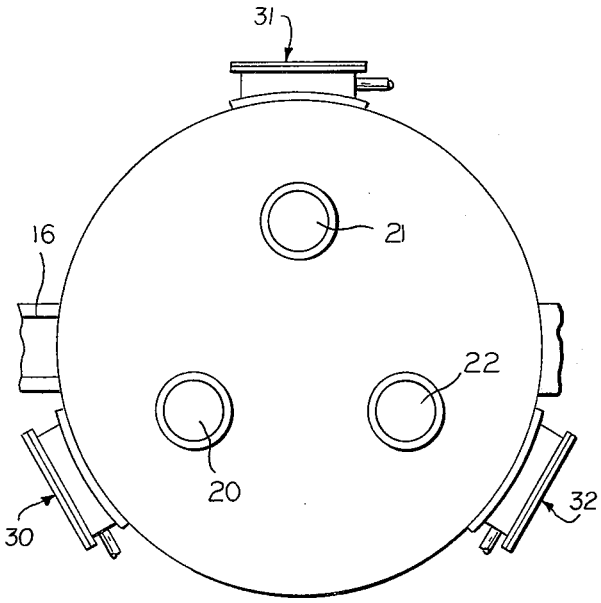
FIG. 2 is a top plan view of the arc furnace illustrated in FIG. 1.
Figure 3:
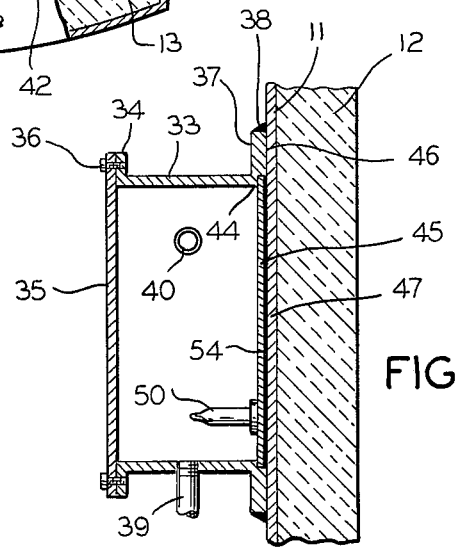
FIG. 3 is a vertical section of a coolant chamber taken on a line corresponding with 3—3 in FIG. 1.

The cooling chambers according to the preferred embodiment of the invention are designated generally by the reference numerals 30,31 and 32 in FIGS. 1 and 2. Chambers 30, 31 and 32 are shown to be located on the outer surface of shell 11 and in an opposed relation relative to the electrodes 20, 21 and 22 respectively. These locations will normally be the hot spots of a three electrode furnace of the type illustrated. However, it will be appreciated that the number and location of each chamber will depend on the size of the vessel and the size and desired capacity of the cooling chambers which will be most propitiously located for absorbing heat where refractory hot spots are likely to exist. It should be understood for example that single large cooling chambers extending halfway around each side of the furnace from the pouring spout to the door may also be used. The cooling chambers 30, 31 and 32 may all be identical and accordingly only chamber 30 will be described in detail. As seen in FIG. 3, cooling chamber 30 may comprise a hollow element 33 which defines a space through which coolant fluid may flow. The hollow element 33 has a peripheral flange 34 for enabling the chamber to be enclosed by a cover 35. The gasket between the margin of the cover 35 and flange 34 is not visible in FIG. 3 but it will be understood that the gasket may be clamped to effect sealing by bolts, not shown, passing through a plurality of bolt holes 36.

Hollow element 33 also has another flange 37 which is in contact relationship with the outer surface of furnace 11. Flange 37 is welded all the way around where its corner terminates on the surface of outer shell 11. The continuous weld is marked 38 and it will be understood to provide a leak proof joint between flange 37 and shell 11. Thus, when cover 35 is bolted in place, the coolant space defined by element 32 is totally enclosed. Coolant inlet and outlet pipes 39 and 41 are connected to element 32, coupled as can be seen in FIG. 2. In the latter figure it is evident that one, two or more coolant chambers such as 30 and 31 may be connected with a coolant input header 42 and the outlets from the chambers may be connected to a coolant fluid outlet header 43.

Flange 37 of hollow element 33 which contacts furnace shell 11 has a shallow recess 44 extending around its perimeter. The depth of this recess is substantially equal to the thickness of a thin sheet metal diaphragm 45. The margins of the diaphragm may be brazed or otherwise secured in a leak proof fashion within recess 44. Face 46 of flange 37 is substantially flush with outer face 47 of the thin diaphragm 45. A horizontal cross section of flange 37 and thin diaphragm 45 is not shown but it will be understood to have a curvature or other shape which permits the diaphragm to conform with the contour of furnace shell 11. The object is to get the maximum area of diaphragm 45 in contact relation with shell 11 to promote heat conductivity from shell 11 to coolant fluid in the hollow volume of the coolant chamber.

Even though the interfacing surfaces of diaphragm 45 and shell 11 are apparently smooth and regular, in a practical case, there are always minor irregularities in the surfaces which result in point contacts between them rather then complete area contact. Consequently, air pockets will exist at the interface and since air is a much poorer conductor than metal, heat transfer will be dimisished.

In accordance with one feature of the invention, improved contact between diaphragm 45 and the outer surface of shell 11 is obtained by evacuating the interface region between the diaphragm and the shell after the coolant chamber is welded in a vacuum tight manner to the shell. When the air is evacuated from the interface, atmospheric pressure deforms the diaphragm and forces it to conform to the contour of the furnace shell so that area contact is increased.

Figure 4:
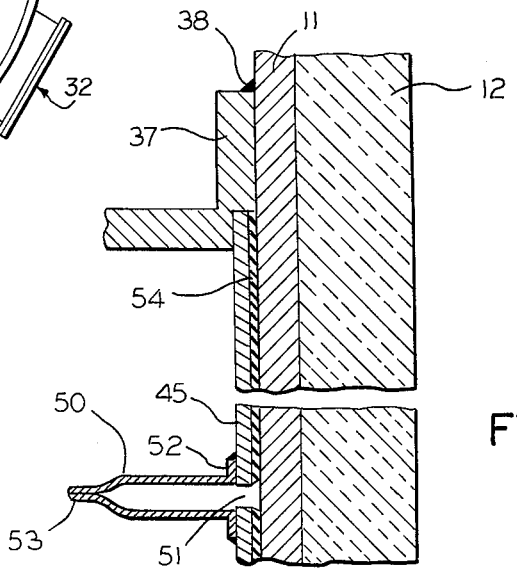
FIG. 4 is an enlargement of a portion of the coolant chamber shown in FIG. 3.

To enable evacuation of the interface, deformable diaphragm 45 is provided with a pinch-off tube 50 which is shown in FIG. 3 and also is enlarged cross section in FIG. 4. In the latter figure one may see that diaphragm 45 is provided with a hole 51 to which tube 50 is attached in a leak proof manner by brazing its end flange 52 to the surface of the diaphragm. Initially, tube 50 is open ended to facilitate connecting it to a vacuum source, not shown. When evacuation is complete, the tube may be pinched off and sealed at its end 53 by techniques which are well known to those practicing vacuum technology.

A further feature of the invention is to improve heat transfer beyond what is obtainable by merely evacuating the interface between diaphragm 45 and shell 11 by using a flowable or deformable conductive coating 54 in the interface as is evident in the FIG. 4 enlargement. This coating is applied to diaphragm 45 before the coolant chamber is welded to the shell. When the vacuum is drawn at the interface the diaphragm is compressed by the atmosphere and the coating material flows into the most minute void at the interface and forms a complete area contact having substantially no discontinuities or voids.

Any suitable material comprised of small particles of heat conductive material in a suitable binder for developing the desired consistency of the material may be used. Colloidal sized particles of graphite or carbon are suitable. Such particles have an optimal average size of between 20 and 30 microns. Other heat conductive particles may be used such as metallic particles or thermally conductive compounds such as the oxides of iron. A suitable conductive mixture comprises about 40% of colloidal heat conductive material, 50% water and 10% inert fillers such as organic binders or clay. This mixture may be spread in a layer on the interfacing surface of thin deformable diaphragm 45 and dried to a large extent before it is fastened to shell 11. Other suitable paste mixtures may comprise a filler such as starch, diatomaceous earth, silica and the like saturated with fine particles having good thermal conductivity.

The thin sheet of metal or diaphragm 45 may be copper, brass, low carbon steel or nickel. Other good metallic corrosion resistant materials may also be used. The thickness of the diaphragm sheet will be governed to some extent by the strength of the material which is chosen. Generally the thickness will be about 0.005 inch to 0.050 inch but, as stated, the thickness can vary depending on the physical properties of the materials selected. In any case, the thickness should not be so great as to result in resistance to deformation under the influence of atmospheric pressure when the interspace is evacuated.

The detailed description of the construction of the coolant chamber set forth in reference to FIGS. 3 and 4 and the deployment of three such chambers on each side of an electric arc furnace as in FIGS. 1 and 2 is intended to be merely illustrative of the invention. It will be appreciated by those skilled in the art that the chamber may be variously configured and constructed depending upon the type of furnace to which it is to be applied. Securing of the diaphragm in the coolant chamber by clamping means other than brazing is also contemplated although such other approaches will usually be more complicated, expensive and less maintenance free. For instance, instead of welding the flange of the coolant chamber to the furnace shell the flange may be provided with bolt holes for permitting the flange to be drawn tightly against the shell on stud bolts projecting from the latter to thereby enable pressing the thin metal diaphragm against the shell. The diaphragm may be mounted in chamber in such manner that it is mechanically pressed into large area contact with the shell and the conductive coating may still be used on the interfacing surfaces.

It should be further evident that a chamber may be so constructed and sized as to girdle an entire furnace of suitable configuration or it may be made in semi-sections which extend substantially halfway around the furnace. Hot spot formation in the refractory linings of a furnace are usually localized if more than one electrode is employed and those skilled in the operation and design of furnaces may readily determine the appropriate size and cooling capacity for a chamber and the most appropriate location thereof.

Although the new cooling device has been described in connection with an electric arc furnace, it will be understood that it is also applicable to other furnaces in which localized or even generalized overheating occurs. For instance, in open hearth furnaces where oxygen is injected through submerged tuyeres, localized hot spots may develop in the refractory side walls and roof. The new cooling chamber may be suitably applied to cool these areas to prevent premature refractory deterioration as in electric arc furnaces.

Thus, the detailed description of a preferred embodiment of the invention set forth herein is intended to be illustrative rather than limiting, for the invention may be variously embodied and is to be limited only by interpretation of the claims which follow.

I claim:

1. A metallurgical vessel having a shell in the interior of which heat is developed, means defining a coolant chamber including an element having a face constructed and arranged for being in substantial contact with the outer surface of said shell for conducting heat therefrom, heat conductive means interposed between said element face and said shell, said heat conductive means being flowable under the influence of a force applied by said element to fill poorly conductive voids which would otherwise exist due to the lack of conformity between said element face and said shell.

2. The invention defined in claim 1 wherein:

said element comprises a relatively thin flexible sheet of heat conductive material.

3. The invention defined in claim 1 and including means for coupling a source of cooling fluid to the interior of said chamber.

4. The invention defined in claim 2 wherein:

the thickness of said element is in the range of about 0.005 to 0.05 inch.

5. The invention defined in claim 2 wherein:

said sheet has the composition of a substance selected from the group consisting of copper, brass, low carbon steel and nickel.

6. The invention defined in claim 1 wherein said heat conductive means includes particles of carbonaceous material.

7. The invention defined in claim 6 wherein said carbonaceous particles are selected from the class consisting of carbon and graphite.

8. The invention defined in claim 7 wherein said particles have an average size of about between 20 and 30 microns.

9. The invention defined in claim 6 wherein said heat conductive materials comprise a major amount of carbonaceous particles and minor amounts of material selected from the group consisting of clay and organic fillers.

10. An electric arc furnace having an outer metal shell and a refractory lining therein defining a space for molten metal, at least one electrode extending into said furnace, means defining a chamber for coolant fluid and including a flexible diaphragm means constructed and arranged to contact said shell in opposed relation to said electrode for conducting heat from said shell, means for effecting a seal between said flexible diaphragm means and said shell to thereby define an enclosed interspace between said flexible means and shell, and said enclosed space being evacuated so that the atmosphere may effect a pressure urging said diaphragm means against said shell.

11. The invention defined in claim 10 including:

a layer of heat conductive material interposed between said flexible diaphragm means and said shell, said material being constructed and arranged when said pressure is effected to fill void spaces having low heat transfer properties that would otherwise exist due to irregularities in the surface of said shell.

12. The invention set forth in claim 11 wherein:

said flexible diaphragm means has a thickness in the range of 0.005 to 0.05 inch and comprises a metal selected from the group consisting of copper, brass, low carbon steel and nickel.

13. The invention defined in claim 12 wherein:

said heat conductive material comprises fine particulate material selected from the group consisting of carbon, graphite and metals and a binder for said particulate material.

14. The invention set forth in claim 13 wherein said furnace includes a plurality of electrodes, one of said chambers being located on said furnace shell opposite each of said electrodes.

15. The method of cooling the exterior shell of a metallurgical vessel comprising the steps of:

providing a cooling chamber adjacent at least a portion of said shell in the area to be cooled, said cooling chamber including a first wall thereof which is constructed of flexible material, placing between said chamber first wall and said shell a quantity of heat conductive deformable material, affixing said chamber to said shell, and evacuating the area between said shell and said flexible material whereby said flexible material is compressed against said deformable material to thereby remove air and fill voids and discontinuities between said shell surface and said flexible material for increasing the heat conductivity between said vessel shell and the coolant space within said cooling chamber.

* * * * *